US006206323B1

(12) United States Patent
Byars

(10) Patent No.: US 6,206,323 B1
(45) Date of Patent: Mar. 27, 2001

(54) YARN PACKAGE HOLDER

(75) Inventor: Larry W. Byars, Greenville, SC (US)

(73) Assignee: Exim Ltd., Greenville, SC (US)

( * ) Notice: Subject to any disclaimer, the term of this patent is extended or adjusted under 35 U.S.C. 154(b) by 0 days.

(21) Appl. No.: 09/476,803

(22) Filed: Dec. 30, 1999

(51) Int. Cl.[7] ..... B65H 75/20

(52) U.S. Cl. ..... 242/577; 242/571.5; 242/127; 242/130

(58) Field of Search ..... 242/577, 577.1, 242/577.2, 577.3, 571.5, 130, 127, 578, 578.2, 613, 118.6, 118.61, 118.62, 129.5, 129.7

(56) References Cited

U.S. PATENT DOCUMENTS

| | | | | |
|---|---|---|---|---|
| 1,296,864 | | 3/1919 | Shearn | 242/130 |
| 2,891,739 | * | 6/1959 | Wolfe | 242/571.5 |
| 3,281,092 | | 10/1966 | Shultz et al. | 242/571.5 |
| 3,285,528 | * | 11/1966 | Beindorf | 242/577.1 X |
| 3,326,495 | * | 6/1967 | De Bruyn | 242/577 |
| 3,980,245 | * | 9/1976 | Delehoy | 242/577 |
| 5,025,999 | * | 6/1991 | Littrell | 242/577 |
| 5,492,280 | | 2/1996 | Corres et al. | 242/130 |

FOREIGN PATENT DOCUMENTS

| | | | | |
|---|---|---|---|---|
| 1636085 | * | 3/1991 | (SU) | 242/577 |

* cited by examiner

*Primary Examiner*—Donald P. Walsh
*Assistant Examiner*—William Rivera
(74) *Attorney, Agent, or Firm*—Brady, O'Boyle & Gates

(57) ABSTRACT

A yarn package holder wherein a plurality of circumferentially spaced blades are pivotally connected to a pair of axially spaced discs adapted to be connected to the creel of a textile machine. A detent assembly is provided between the blades and discs so that the blades can be pivoted and fixed at a desired radial position relative to the discs for supporting yarn package tubes of different diameters. The blades are rigidly held against the inside surface of the yarn package tube.

4 Claims, 8 Drawing Sheets

YARN PACKAGE HOLDER

BACKGROUND OF THE INVENTION

In U.S. Pat. No. 5,039,026 dated Aug. 13, 1991, and owned by the assignee of the instant invention, there is disclosed a yarn package holder for accomodating yarn package tubes of various diameters wherein a contact arm is connected in a cantilevered manner to a base support operatively connected to a creel for a textile machine. A spring assembly is connected to the contact arm which engages the inside wall of a yarn package tube, whereby yarn tubes of various diameters can be accomodated by the holder.

While this holder has been satisfactory for its intended purpose, it has been characterized by certain disadvantages in that it has been found that the yarn packages have to be positioned off-center on the creel. This off-center positioning can cause yarn tension variations which are not acceptable for certain types of yarn, and the off-center position made it difficult to employ this type of package holder for revolving yarn package holders because the off-center design did not permit the package to turn in a manner that will maintain uniform tension as yarn is being run from the package. Furthermore, the spring material in the spring assembly becomes fatigued after long and continued use; thus, losing its biasing force so that the same holder for a small diameter package tube could not be used for a large diameter package tube.

After considerable research and experimentation, the yarn package holder of the present invention has been devised which firmly engages the inside wall of a yarn package tube and is adjustable to accomodate yarn package tubes of various diameters.

SUMMARY OF INVENTION

The yarn package holder of the present invention comprises, essentially, a pair of axially spaced discs and a plurality of circumferentially spaced blades pivotally connected at each end along their longitudinal axes to a respective disc. A detent assembly is provided between the blades and the discs whereby the blades can be pivoted and locked at a desired radial position relative to the discs, whereby the radial position of the blades can be adjusted to accomodate yarn package tubes of different diameters. By this construction and arrangement, the blades are rigidly held against the inside surface of the yarn package tube.

DESCRIPTION OF THE PREFERRED EMBODIMENT

Figure 1:
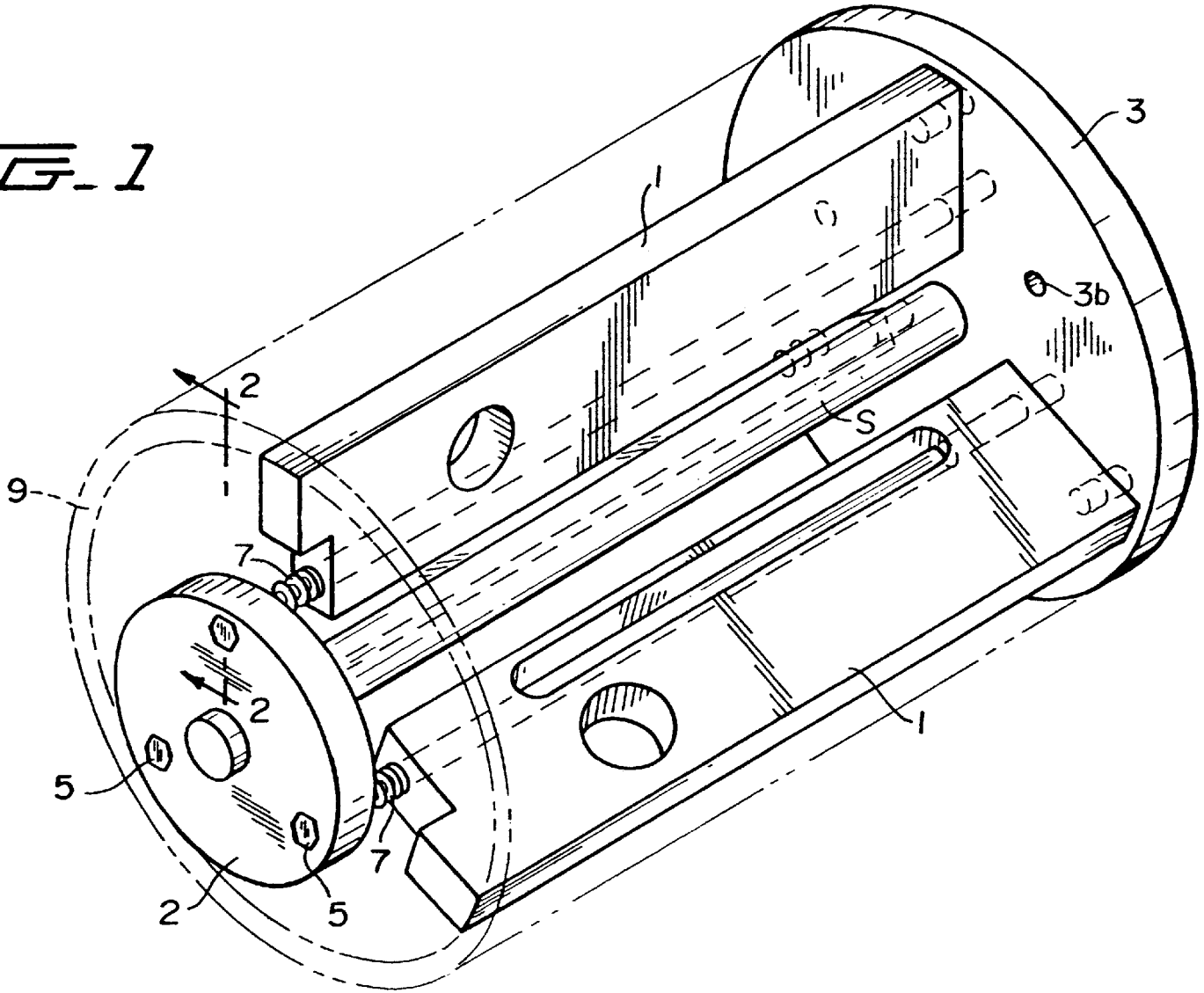
FIG. 1 is a perspective view of one embodiment of the yarn package holder of the present invention.

Referring to the drawings and more particularly to FIG. 1, an embodiment of a yarn package holder is illustrated wherein a plurality of longitudinally extending, circumferentially spaced blades 1 are mounted between a pair of axially spaced discs 2 and 3, supported on a shaft S,connected to a textile machine creel, not shown.

Figure 2:
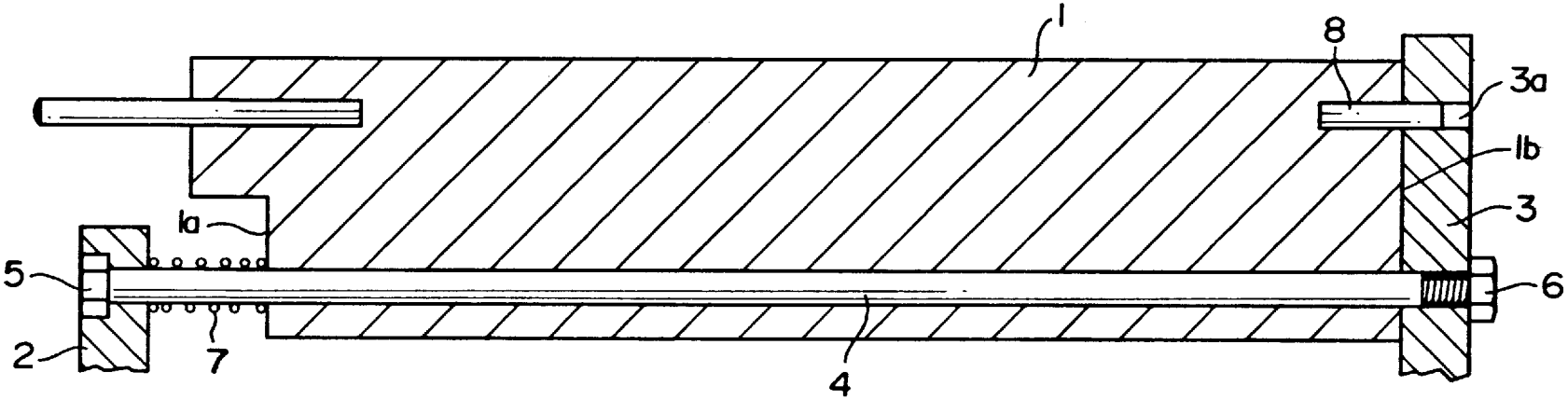
FIG. 2 is a view taken along line 2—2 of FIG. 1.

The details of the connection of each blade 1 to the discs 2 and 3 are illustrated in FIG. 2, wherein it will be seen that the blade 1 is pivotally mounted on an axially extending rod 4, fixedly connected at each end to the discs 2 and 3, as at 5 and 6. The blade 1 is biased in a direction toward the disc 3 by a coil spring 7 mounted concentric with the rod 4 between the disc 2 and end portion 1*a* of the blade 1. The opposite end portion 1*b* of the blade 1 is provided with a pin 8 adapted to be received in an aperture 3*a* provided in the disc 3, whereby the blade 1 is held in a stationary manner between the discs 2 and 3.

Figure 3:
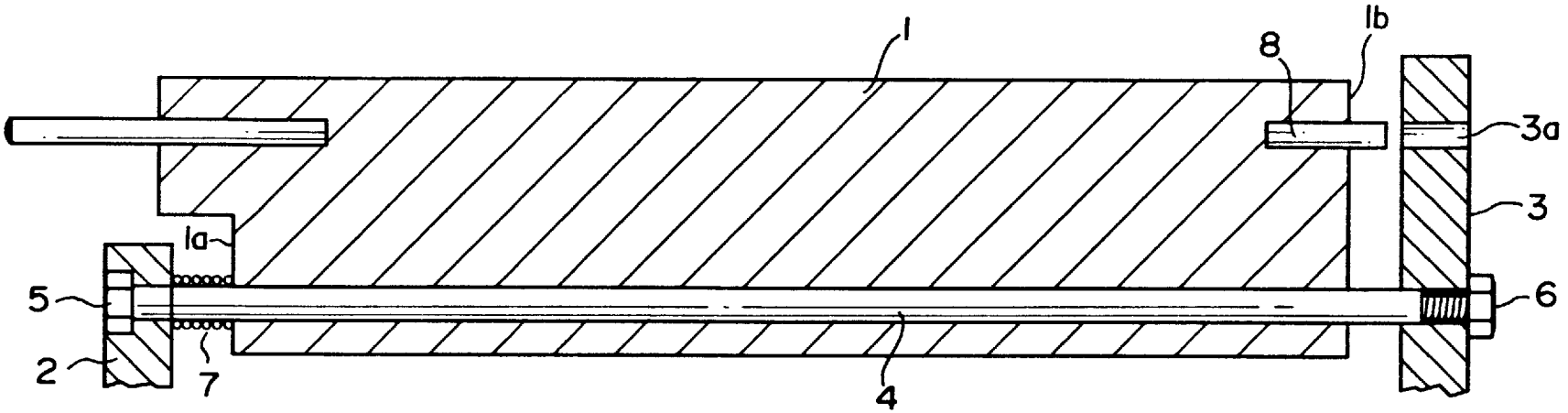
FIG. 3 is a view similar to FIG. 2, but showing a blade in a released position.

Referring to FIG. 3, the blade 1 can be released from the disc 3 by moving the blade 1 in a direction toward disc 2, thereby compressing spring 7 while simultaneously pulling the pin 8 from the aperture 3*a*.

Figure 4:
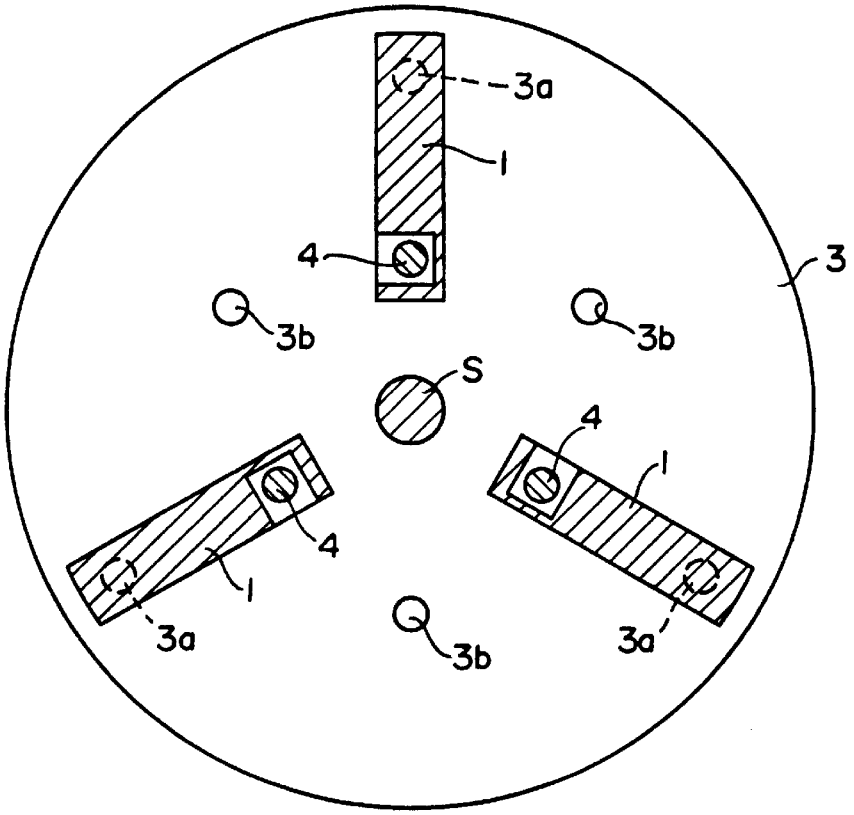
FIG. 4 is an end elevational view, partly in section, showing the blades of FIG. 1 adjusted to a radial position for receiving a large diameter yarn tube.
Figure 6:
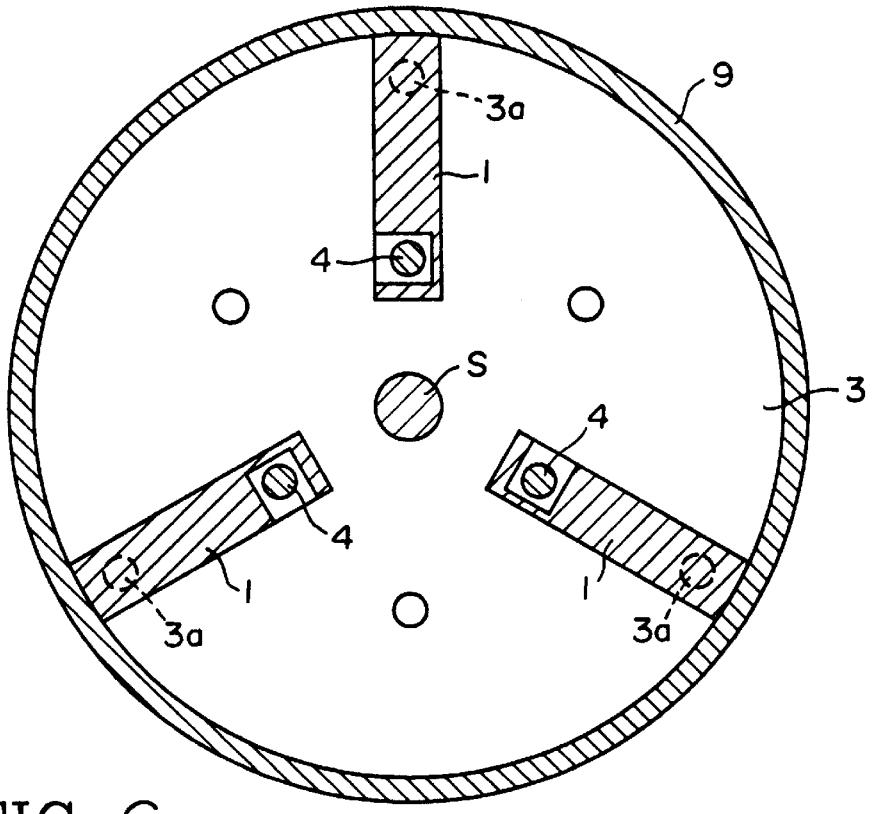
FIG. 6 is a view similar to FIG. 4 showing the blades supporting a large diameter yarn tube.

As will be seen in FIG. 4, the disc 3 is provided with a plurality of the apertures 3*a* which are circumferentially spaced from each other and positioned radially outwardly from another plurality of circumferentially spaced apertures 3*b*. When the blades 1 are oriented as shown in FIG. 4, they are positioned to support a large diameter yarn package tube 9 as shown in FIG. 6.

Figure 5:
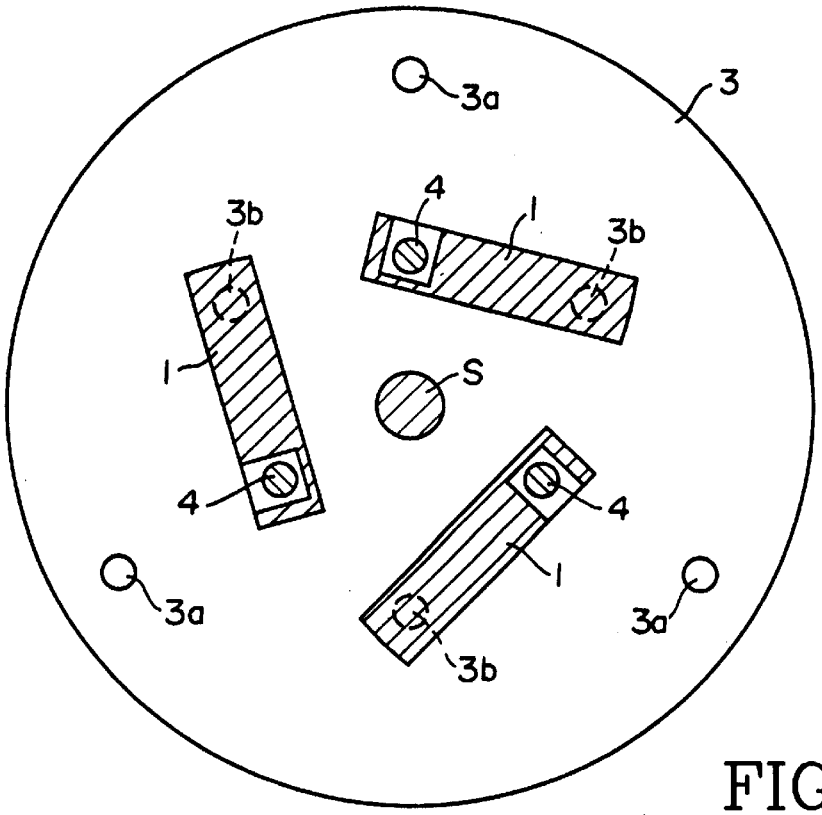
FIG. 5 is an end elevational view, partly in section, showing the blades illustrated in FIG. 4 adjusted to a radial position for receiving a small diameter yarn tube.
Figure 7:
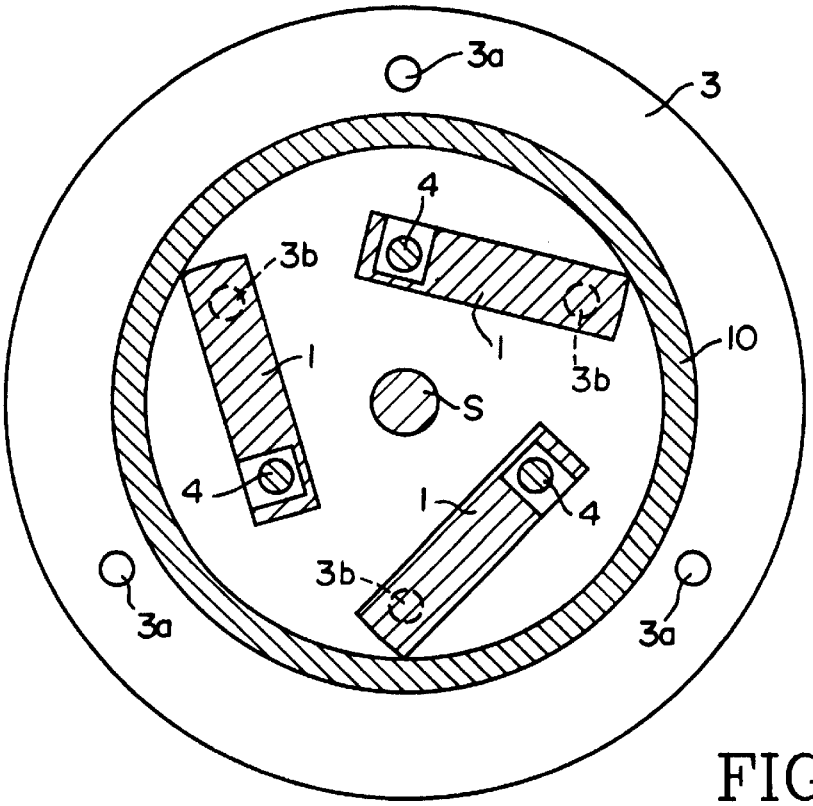
FIG. 7 is a view similar to FIG. 5 showing the blades supporting a small diameter yarn tube.

To support a small diameter yarn package tube, each blade 1 is disconnected from the disc 3, as shown in FIG. 3, and then pivoted to align a respective pin 8 with a respective aperture 3*b*. The blade 1 is released and the biasing force of the spring 7 pushes the pin 8 into the aperture 3*b*, whereby the blades 1 are oriented as shown in FIG. 5 for supporting a small diameter yarn package tube 10 as shown in FIG. 7.

Figure 8:
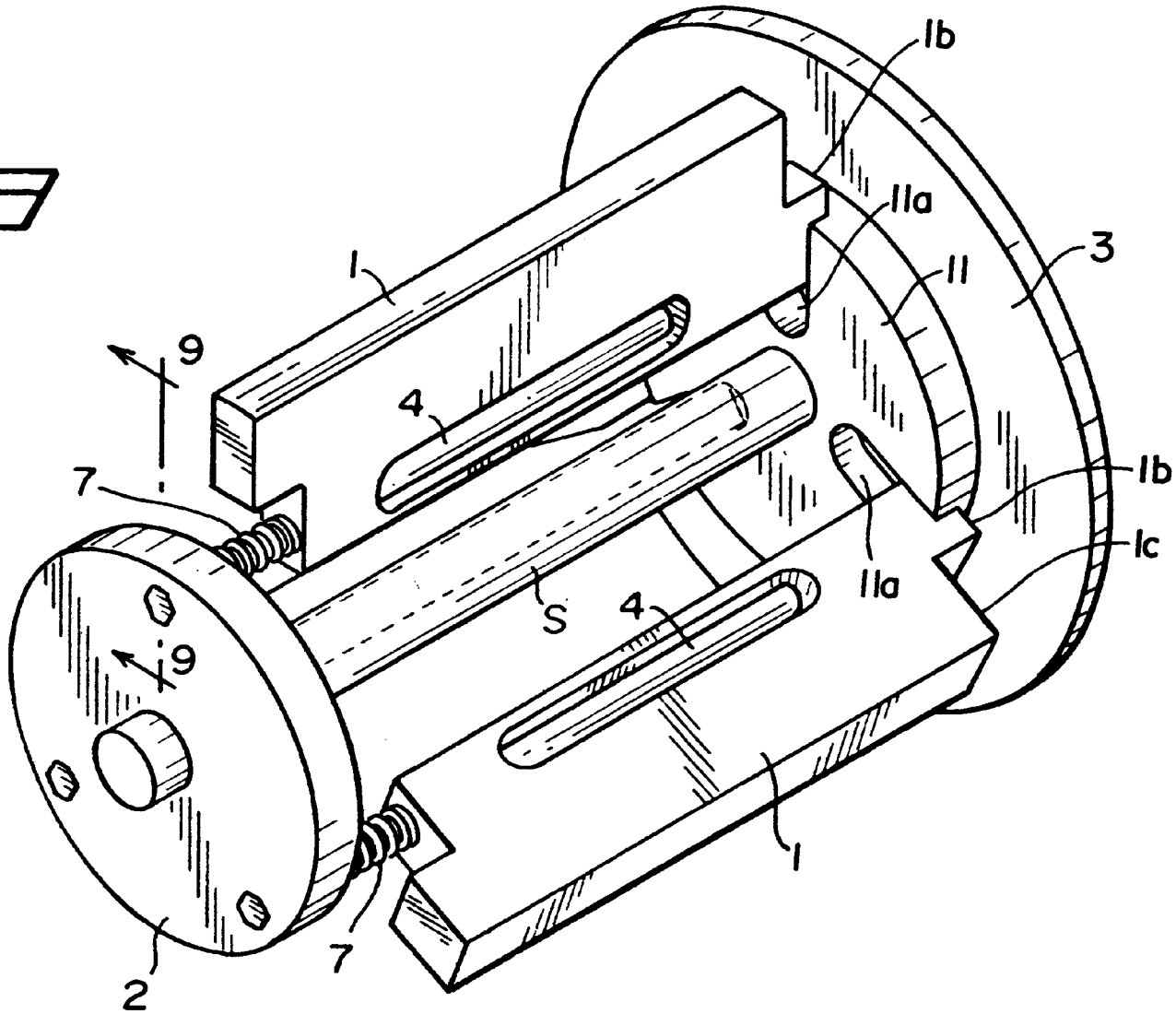
FIG. 8 is a perspective view of another embodiment of the yarn package holder of the present invention.
Figure 9:
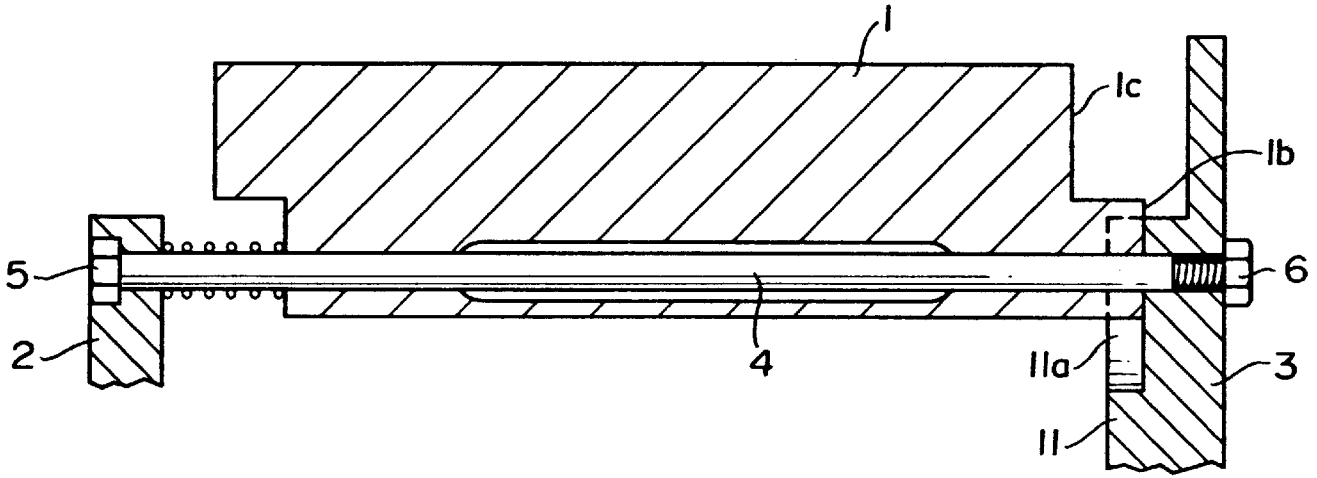
FIG. 9 is a view taken along line 9—9 of FIG. 8.

While the embodiment of the yarn package holder shown in FIGS. 1 to 7 employ pin 8 and disc apertures 3*a*, 3*b* for holding the blades in a selective orientation, FIG. 8 illustrates another embodiment for releasably connecting the blades 1 to the disc 3. In this embodiment, a face plate 11 is fixedly mounted on the disc 3 and is provided with a plurality of circumferentially spaced, radially extending, through slots 11*a* adapted to receive the respective end portions 1*b* of the blades 1. A shoulder 1*c* is provided on each blade 1 and is also adapted to be received in a respective slot 11*a*.

Figure 11:
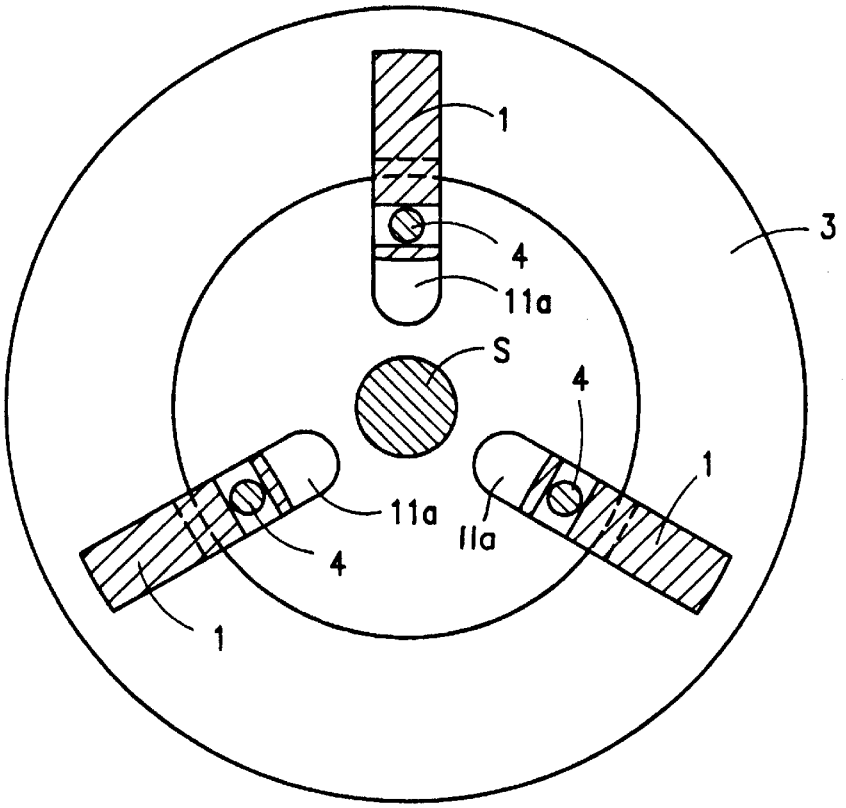
FIG. 11 is an end elevational view, partly in section, showing the blades of FIG. 8 adjusted to a radial position for receiving a large diameter yarn tube.
Figure 13:
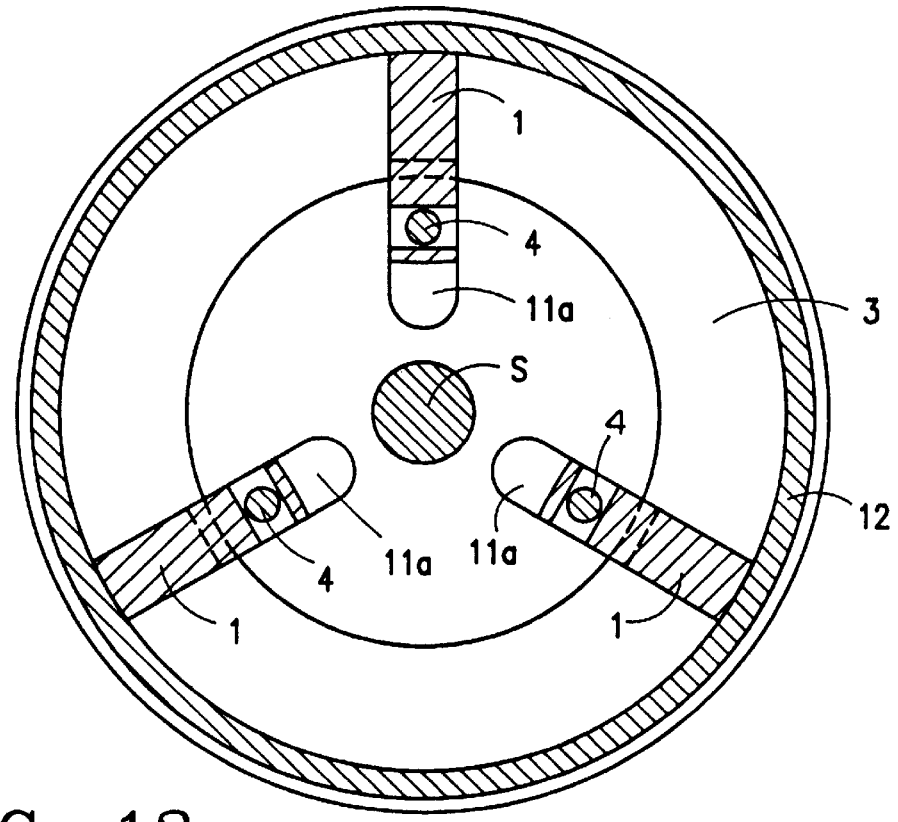
FIG. 13 is a view similar to FIG. 11, showing the blades supporting a large diameter yarn tube.

When the blades 1 are positioned as shown in FIGS. 8 and 11, the end portions 1*b* are received in the slots 11*a* to thereby orient the blade 1 for supporting a large diameter yarn package tube 12, as shown in FIG. 13.

Figure 10:
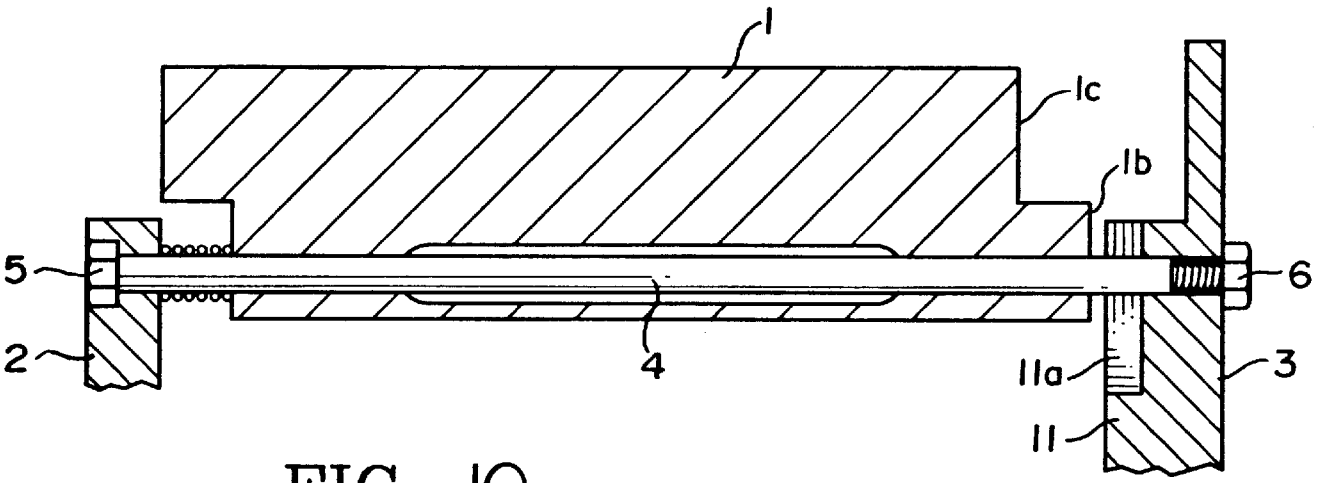
FIG. 10 is a view similar to FIG. 9, but showing a blade in a released position.
Figure 12:
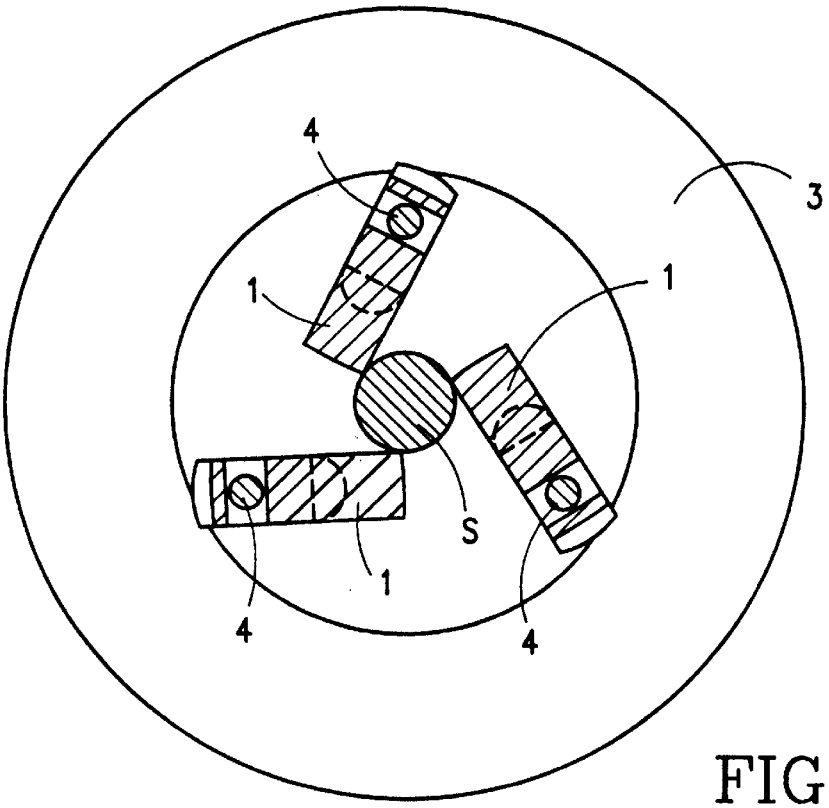
FIG. 12 is an end elevational view, partly in section, showing the blades of FIG. 8 adjusted to a radial position for receiving a small diameter yarn tube.
Figure 14:
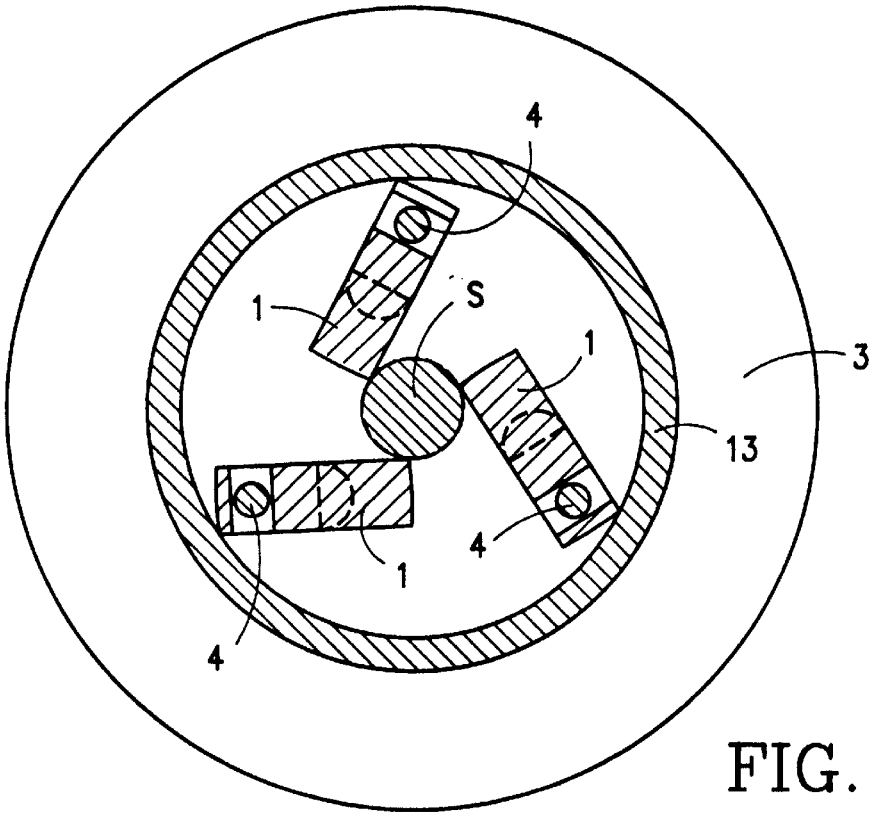
FIG. 14 is a view similar to FIG. 12, showing the blades supporting a small diameter yarn tube.

To position the blades for supporting a small diameter yarn package tube, the end portion 1*b* of each blade 1 is removed from its respective radial slot 11*a*, as shown in FIG. 10, and then pivoted 180° to align the shoulder 1*c* with the slot 11*a*. The blade 1 is then released so that the shoulder 1*c* is received in the slot 11*a*, thereby orienting the blades 1 to a position shown in FIG. 12 for supporting a small diameter yarn package tube 12, as shown in FIG. 14.

By the construction and arrangement of the spring biased blades 1 and associated pin 8 and aperture 3*a*, 3*b*, or blade end 1*b* and shoulder 1*c* with the radial slots 11*a*, a detent connection is provided between the blades 1 and disc 3, whereby the blades can be easily and quickly oriented for supporting large and small diameter yarn package tubes, wherein the blades are rigidly held against the inside surface of the yarn package tube.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. A yarn package holder comprising a pair of axially spaced discs, a plurality of circumferentially spaced blades extending between said discs, said blades being adapted to engage the inside surface of a yarn package tube, means for pivotally connecting each blade to said discs, and detent means connected between each blade and the discs for releasably connecting the blades at a desired radial position relative to the discs, whereby the radial position of the blades can be adjusted to accomodate yarn package tubes of different diameters wherein the blades are rigidly held against the inside surface of a yarn package tube.

2. A yarn package holder according to claim 1, wherein the means for pivotally connecting each blade to the discs comprises a rod extending axially through the blade and fixedly connected at each end to a respective disc.

3. A yarn package holder according to claim 2, wherein the detent means comprises a spring mounted concentric with the rod between one of the discs and an end portion of the blade, an axially extending pin connected to the other end portion of said blade, and a plurality of circumferentially and radially spaced apertures in the other disc adapted to selectively receive said pin.

4. A yarn package holder according to claim 2, wherein the detent means comprises a spring mounted concentric with the rod between one of the discs and an end portion of the blade, a plurality of circumferentially spaced, radially extending through-slots provided in a face of the other disc, a shoulder provided on the other end of said blade, said slot being adapted to selectively receive a portion of the other end of said blade or said shoulder, whereby when the said portion of the other end of said blade is inserted into said slot, the blade is oriented for supporting a large diameter yarn package tube, and when the shoulder is inserted into the slot, the blade is oriented for supporting a small diameter yarn package tube.

* * * * *